US010966493B2

(12) United States Patent
Dadlani

(10) Patent No.: US 10,966,493 B2
(45) Date of Patent: Apr. 6, 2021

(54) CHARM KEEPER ASSEMBLY

(71) Applicant: Island Trinketz LLC, Montego Bay (JM)

(72) Inventor: Raveen Lachman Dadlani, Montego Bay (JM)

(73) Assignee: Island Trinketz, LLC, Miami, FL (US)

( * ) Notice: Subject to any disclaimer, the term of this patent is extended or adjusted under 35 U.S.C. 154(b) by 0 days.

(21) Appl. No.: 15/774,977

(22) PCT Filed: Aug. 24, 2017

(86) PCT No.: PCT/US2017/048488
§ 371 (c)(1),
(2) Date: May 9, 2018

(87) PCT Pub. No.: WO2019/040073
PCT Pub. Date: Feb. 28, 2019

(65) Prior Publication Data

US 2020/0046088 A1 Feb. 13, 2020

(51) Int. Cl.

| | |
|---|---|
| ***A44C 5/00*** | (2006.01) |
| ***A44C 5/20*** | (2006.01) |
| ***A44C 25/00*** | (2006.01) |
| *A44C 15/00* | (2006.01) |

(52) U.S. Cl.
CPC ..... *A44C 5/2042* (2013.01); *A44C 5/0053* (2013.01); *A44C 25/007* (2013.01); *A44C 15/005* (2013.01); *A44D 2200/10* (2013.01)

(58) Field of Classification Search
CPC ... A44C 5/2042; A44C 5/0053; A44C 25/007; A44C 15/005; A44C 5/0061; A44C 5/0007; A44C 25/001; A44C 25/00; A44C 5/2076; A44C 5/2047; A44C 5/2066; A44C 5/2071; A44D 2200/10; Y10T 29/49595;
(Continued)

(56) References Cited

U.S. PATENT DOCUMENTS 4,286,360 A * 9/1981 Skobel ..... A44C 5/20 222/211
4,494,279 A * 1/1985 Kilguss ..... A44C 5/20 24/336
4,551,993 A 11/1985 Nagahori
(Continued)

*Primary Examiner* — Jack W Lavinder
(74) *Attorney, Agent, or Firm* — Mark C. Johnson; Johnson Dalal

(57) ABSTRACT

A charm keeper assembly that includes a first and a second clasp member disposed at respective free ends of a strand member and a charm keeper body having a keeper body thickness and independently disposed adjacent to a clasp member and having a spring-loaded charm retention member at least partially housed within the keeper body. The charm retention member includes a retention surface spanning upwardly in a transverse direction away from an outer surface of the charm keeper body to a terminal end defining a keeper offset length when the spring-loaded charm retention member is in a fully extended position along a retention member translation path. The assembly also includes at least one charm member defining a lumen with a lumen diameter having a maximum length less than the offset length and the keeper body thickness, combined, when the charm retention member is in the fully extended position.

16 Claims, 7 Drawing Sheets

(58) Field of Classification Search
CPC ..... Y10T 29/49838; Y10T 29/49591; Y10T 24/45534; Y10T 24/4736; Y10T 24/4745
USPC ..... 63/3, 3.1, 4, 21, 23, 40
See application file for complete search history.

(56) References Cited

U.S. PATENT DOCUMENTS

| | | | |
|---|---|---|---|
| 4,562,704 | A | 1/1986 | Benedek et al. |
| 4,590,649 | A | 5/1986 | Neilson, Jr. |
| 6,722,036 | B2 | 4/2004 | Pratt |
| 7,007,507 | B2 | 3/2006 | Enevoldsen |
| 7,540,172 | B2 | 6/2009 | Julkowski et al. |
| 8,225,625 | B2 | 7/2012 | Heiden et al. |
| 2002/0139141 | A1 | 10/2002 | Kuwayama |
| 2004/0144131 | A1 | 7/2004 | Enevoldsen |
| 2009/0013720 | A1 | 1/2009 | Altick |

* cited by examiner

100

CHARM KEEPER ASSEMBLY

CROSS-REFERENCE TO RELATED APPLICATION

This application is a national stage filing of International Application Number PCT/US17/48488, filed Aug. 24, 2017, the entirety of which is incorporated herein by reference.

FIELD OF THE INVENTION

The present invention relates generally to keepers used to retain charms and other jewelry from unintentionally being removed from a bracelet, necklace, or other elongated chain member.

BACKGROUND OF THE INVENTION

Many users who use necklaces and bracelets also utilize charms and/or beads that are designed to be inserted and removed through an end of a flexible chain or strand of said necklaces and bracelets. These charms and/or beads are typically formed with a bore or aperture that spans therethrough (also referred to as a "lumen"). The beads or charms may have spiritual, cultural, or have other personal or financial value to a user, and many users desire to change their beads or charms depending on their mood and/or desired expression. To that end, many users desire to prevent the unintentional loss of these charms and/or beads, as it would cause them emotional pain or stress, while simultaneously being able to quickly and efficiently replace and/or exchange these charms.

Some known chains or strains have a plurality of beads that are retained by being strung and fastened on the strand via the lumen in the bead and/or have a loop or tie in knot adjacent to the ends of said bead. These beads, however, are very difficult to remove and insert onto the chain, making assembly and disassembly a time-consuming and often arduous task.

There are also some known chains that include a male clasp member and a female clasp member, whereby the male clasp is operable to engage and lock with the female clasp and act as a keeper to prevent beads from exiting the chain. The male member includes two planar members, with one of the planar members of a spring material biased in an expanded position to prevent beads from existing and, when in a compressed position, permits beads to be inserted onto the chain. One such example can be seen in U.S. Pat. No. 4,562,704, issued to Benedek et al. This configuration, however, is prone to failure over time as the spring planar member loses its elasticity and/or plastically deforms or breaks at its fulcrum, e.g., through a bead passing in between the two planar members and/or compressing the spring member low enough for it to enter the female member. Additionally, because the keeper male end is also used to fasten the ends of the chain together, its failure results in the inability to use the chain for its intended purpose.

Additional known chains designed to retain beads thereon include one or more ends, or segments, of said chains including a threaded member operable to receive a bead with a threaded portion corresponding to the threaded member of the chain. These designs, however, are problematic in that the threads degrade over time after repeated use. Moreover, to insert and remove a bead, it generally takes more time, which many users find undesirable.

Therefore, a need exists to overcome the problems with the prior an as discussed above.

SUMMARY OF THE INVENTION

The invention provides a charm keeper that overcomes the hereinafore-mentioned disadvantages of the heretofore-known devices and methods of this general type and that effectively and efficiently prevents beads, charms, and/or other jewelry from inadvertently leaving the confines of a bracelet, necklaces, or other elongated strand member.

With the foregoing and other objects in view, there is provided, in accordance with the invention, a charm keeper assembly that includes an elongated and flexible strand member having a first free end and a second free end opposing the first free end, wherein the strand member defines a strand member diameter. The assembly may also include a first clasp member disposed at the first free end of the elongated strand member and a second clasp member disposed at the second free end of the elongated strand member, wherein the first and second clasp members are operably configured to engage and lock with one another to couple the first and second free ends together and form a circular shape, e.g., to surround a user's wrist or neck. The assembly also includes a charm keeper body with a keeper body thickness and may be independently disposed adjacent to at least one of the first and second clasp members and may have a spring-loaded charm retention member at least partially housed within the keeper body and include a retention surface spanning upwardly in a transverse direction away from an outer surface of the charm keeper body to a terminal end defining a keeper off-set length when the spring-loaded charm retention member is in a fully extended position along a retention member translation path. Additionally, the assembly may include at least one charm member defining a lumen with a lumen diameter having a maximum length less than the off-set length and the keeper body thickness, combined, when the charm retention member is in the fully extended position, and greater than the strand member diameter.

In accordance with another feature, an embodiment of the present invention includes the retention member translation path having a compressed position with the keeper off-set length and the keeper body width, combined, less than the lumen diameter.

In accordance with yet another feature, an embodiment of the present invention also includes the spring-loaded charm retention member having an upper surface disposed outside of the keeper body, when the charm retention member is in the fully extended position, wherein the upper surface of the spring-loaded charm retention member is of a curvilinear shape. Additionally, the spring-loaded charm retention member also includes a height separating the upper surface of the spring-loaded charm retention member and the outer surface of the charm keeper body, wherein, when the charm retention member is in the fully extended position, the height tapers in a longitudinal direction toward the at least one of the first and second clasp members adjacent to the charm keeper body.

In accordance with a further feature of the present invention, the first clasp member is of a male configuration and the second clasp member is of a female configuration sized and shaped to receive a portion of the male configuration, wherein the first clasp member is disposed adjacent to the charm keeper body.

In accordance with a further feature of the present invention, the first clasp member is of a male configuration and the second clasp member is of a female configuration sized and shaped to receive a portion of the male configuration, wherein the first clasp member disposed adjacent to the charm keeper body. The charm keeper body may define an aperture sized and shaped to permit the spring-loaded charm retention member to translate therethrough. The aperture may be a single aperture defined on the keeper body.

In accordance with an additional feature of the present invention, the keeper body is of a cylindrical shape and has a maximum keeper body thickness, along with a maximum thickness of the male configuration, that is less than a minimum length of the lumen diameter.

In accordance with an additional feature, an embodiment of the present invention also includes the keeper body having a spring assembly housed therein and is operably configured to permit the spring-loaded charm retention member to translate through an aperture defined by the keeper body, wherein the spring assembly biases the spring-loaded charm retention member in the fully extended position.

In accordance with the present invention, a charm keeper assembly is also disclosed that includes an elongated and flexible strand member having a first free end and a second free end opposing the first free end. The assembly may also include a first clasp member of a male configuration disposed at the first free end of the elongated strand member and a second clasp member of a female configuration disposed at the second free end of the elongated strand member, wherein the male and female configurations are operably configured to engage and lock with one another to couple the first and second free ends together and form a circular shape. The assembly may also include a charm keeper body with a keeper body thickness and disposed adjacent to the first clasp member and having an outer surface enclosing a spring assembly, the outer surface defining an aperture thereon. The assembly also includes a charm retention member at least partially housed and retained within the keeper body, protruding from the aperture defined by the charm keeper body, and including a retention surface spanning upwardly in a transverse direction away from the outer surface of the charm keeper body to a terminal end defining a keeper off-set length when the charm retention member is in a fully extended position along a retention member translation path, wherein the spring assembly biasing the spring-loaded charm retention member in the fully extended position. The assembly also includes at least one charm member defining a lumen with a lumen diameter having a maximum length less than the off-set length when the charm retention member is in the fully extended position and the keeper body thickness, combined.

Although the invention is illustrated and described herein as embodied in a charm keeper assembly, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances, these terms may include numbers that are rounded to the nearest significant figure. In this document, the term "longitudinal" should be understood to mean in a direction corresponding to an elongated direction of the strand member spanning to and from its opposing ends.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
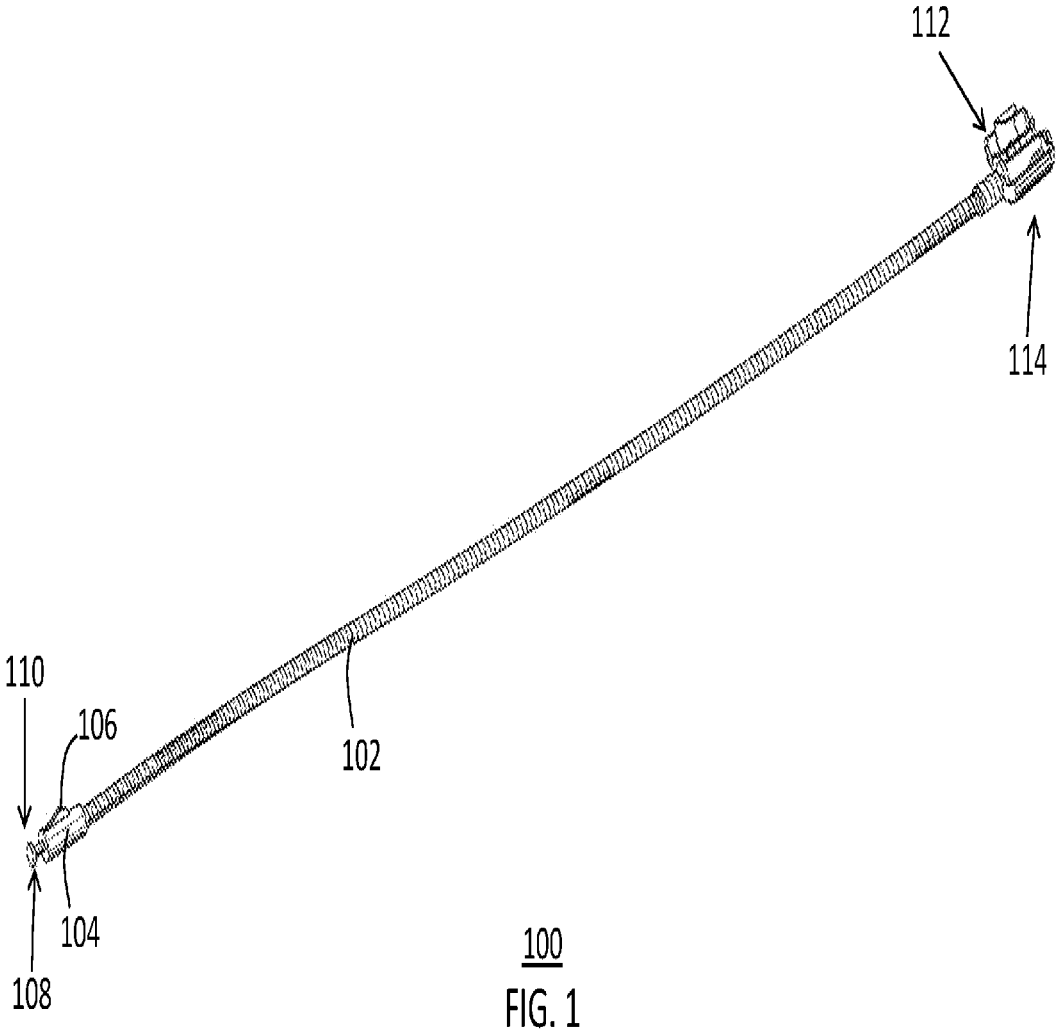
FIG. 1 is a perspective view of a charm keeper assembly in accordance with one embodiment of the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient charm keeper assembly employed, for example, on a flexible stand member commonly embodied in the form of a bracelet, necklace, or the like. Embodiments of the invention provide a quick and effective way to insert and remove one or more pieces of jewelry onto the strand member, while simultaneously providing a user the ability to retain said one or more pieces of jewelry on the strand member when the opposing ends of the strand member are uncoupled from one another.

Figure 2:
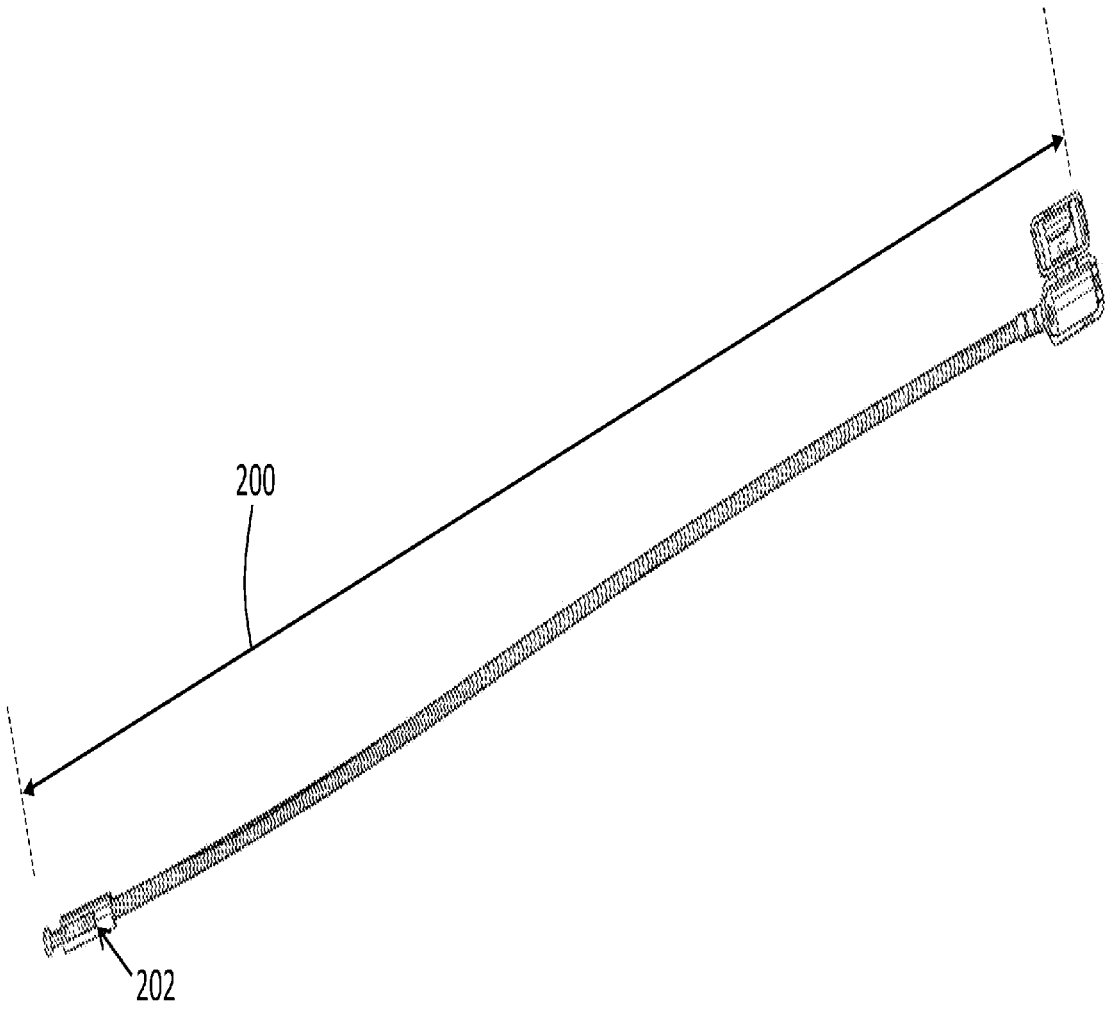
FIG. 2 is another perspective view of the charm keeper assembly of FIG. 1.
Figure 7:
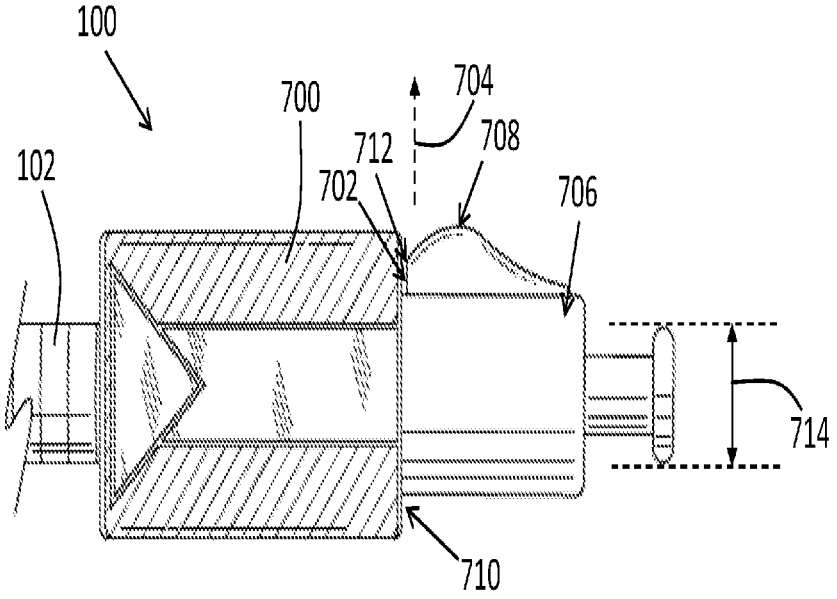
FIG. 7 is an elevational side view of an exemplary charm disposed on the strand member and prevented from exiting the strand member via the charm retention member, in accordance with one embodiment of the present invention.

Referring now to FIGS. 1-2, one embodiment of the present invention is shown in multiple perspective views. FIGS. 1-2, along with the other figures, show several advantageous features of the present invention, but, as will be described below, the invention can be provided in several shapes, sizes, combinations of features and components, and varying numbers and functions of the components. The first example of a charm keeper assembly 100, as shown in FIG. 1, includes an elongated and flexible strand member 102, a charm keeper body 104, a charm retention member 106, a first clasp member 108 disposed at a first end 110 of the member 102, and a second clasp member 112 disposed at a second end 114 of the member 102. As best seen in FIG. 7, the charm keeper assembly 100 beneficially prevents undesired or unintentional release of one or more charms, beads, or other jewelry pieces (e.g., charm 700) from the flexible strand member 102 when the ends 110, 112 are uncoupled from one another.

Referring to FIGS. 1-2, as those of skill in the art will appreciate, the strand member 102 is "flexible," in that it is capable of repeated bending and flexing without plastic deformation of the material of which the strand member 102 is composed, e.g., fabric, metal, a polymeric material, a ceramic, or other material. In one embodiment, the strand member 102 is of a stainless-steel material having a total strand member length 200 of approximately 6-8 inches (designed for a bracelet) and a substantially uniform diameter of approximately 0.1-0.25 inches. In other embodiments, other dimensions may be employed based on design constraints and/or the particular application (e.g., 16-24 inches for a necklace). As those of skill in the art will also appreciate, the ends of the strand member 102 are "free." in that they have the ability to move freely and are not permanently and structurally attached to another object.

As such, a first clasp member 108, disposed at the first free end 110, and a second clasp member 112, disposed at the second free end 114, are operably configured to engage and lock with one another to couple the first and second free ends 110, 114 together and form a circular shape (e.g., to enclose a user's wrist or neck). In one exemplary embodiment, the first and second clasp members are 108, 112 are of a cylindrical friction-snap assembly. Specifically, as best shown in FIGS. 3-6, the second clasp member 112 is of a female configuration 400, the first clasp member 108 is of a male configuration 300, whereby the male configuration 300 is inserted into the female configuration 400. Thereafter, a cover portion 402 of the second clasp member 112, having a friction-engaging member 404, is rotated and closed on the lower portion 406 to engage with and lock there onto. As such, the male configuration 300 is prevented from being removed (transversely or longitudinally) from the female configuration 400 without separating the cover portion 402 from the lower portion 406, thereby disengaging the friction-engaging member with the lower portion 406.

Said another way, the first and second clasp members 108, 112 are operably configured to engage with one another to prevent (without user intervention) the clasp members 108, 112 (and ends 110, 114) from separating or uncoupling. While one exemplary type of clasp member is depicted in the figures, other clasp members may be employed. For example, other exemplary clasp members, such as add-a-bead clasps, adjustable clasps, ball-and-joint clasps, bar-and-ring clasps, barrel clasps, bead clasps, box clasps, button toggle clasps, crimping clasps, lobster claw clasps, springing clasps, may be utilized.

Figure 3:
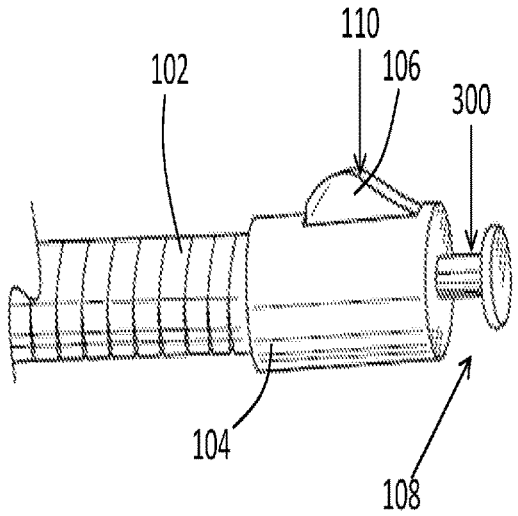
FIG. 3 is a close-up perspective view of a charm keeper body, a charm retention member, and a first clasp member in accordance with one embodiment of the present invention.
Figure 4:
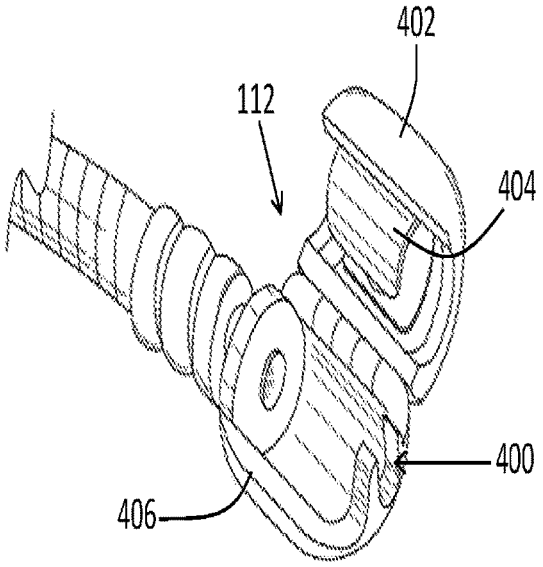
FIG. 4 is a close-up perspective view of a second clasp member in accordance with one embodiment of the present invention.
Figure 5:
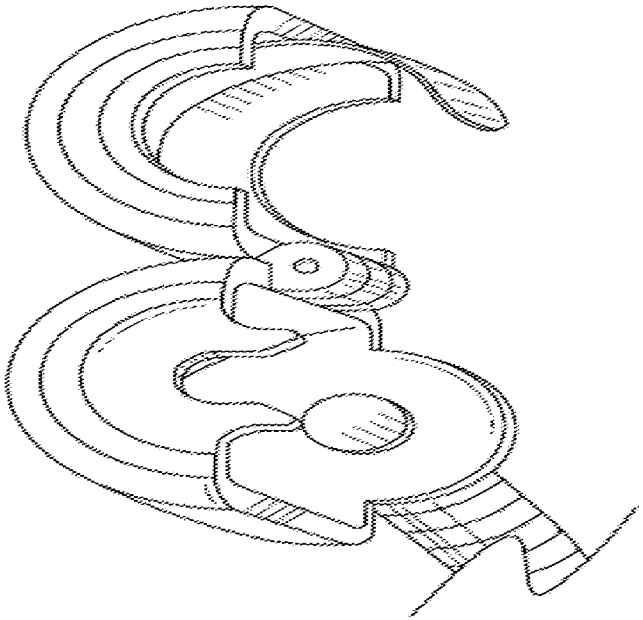
FIG. 5 is a close-up perspective front view of a second clasp member in accordance with one embodiment of the present invention.
Figure 6:
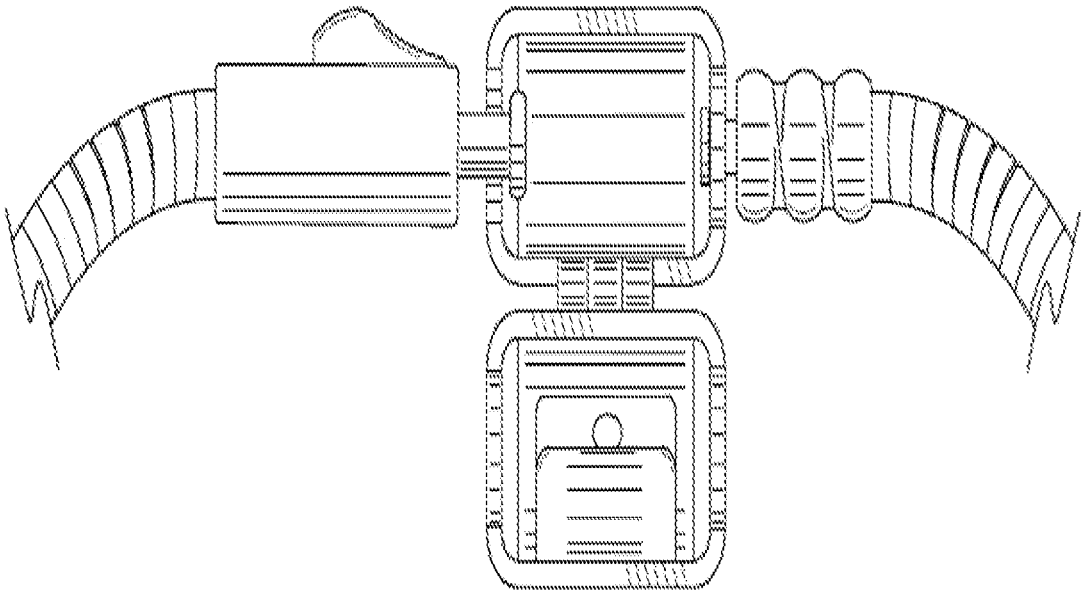
FIG. 6 is an elevational side view of the first and second clasp members in a coupling configuration in accordance with an exemplary embodiment of the present invention.

With reference to FIGS. 3 and 6, the charm keeper body 104 may be independently disposed adjacent to the first clasp member 108. Said another way, the charm keeper body 104 is a structure that is not used to fasten or couple the strand member 102 together, i.e., it would be the clasps members 108, 112 that function to fasten or couple the strand member 102. Said even further, the charm keeper body 104 is independent of fastening, as best seen in FIG. 6.

Figure 8:
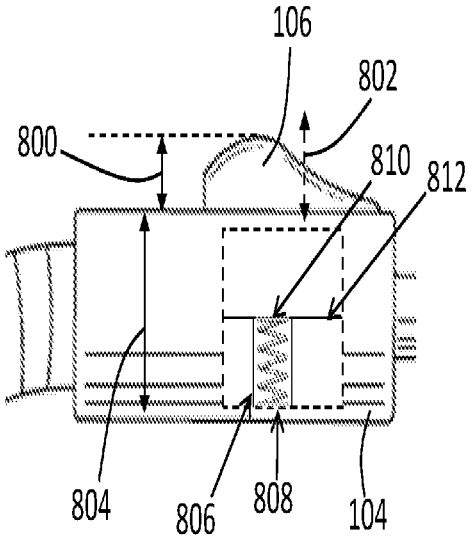
FIG. 8 is an elevational partially transparent, view of the charm retention member in a fully extended position along a retention member translation path in accordance with the present invention.
Figure 9:
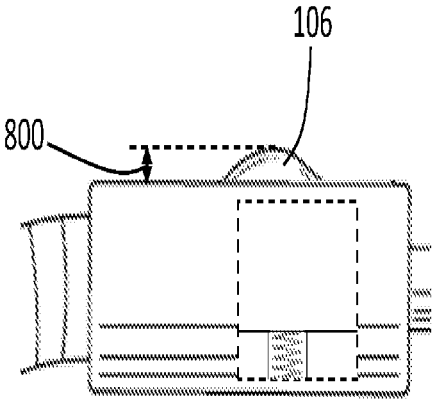
FIG. 9 is an elevational, partially transparent, view of the charm retention member in a compressed position along the retention member translation path in accordance with the present invention.

With reference to FIGS. 7-9, the charm keeper body 104 may beneficially include the spring-loaded charm retention member 106 at least partially housed within the keeper body 104. The spring-loaded charm retention member 106 operates to retain one or more charms 700 housed on the strand member 102, thereby inhibiting inadvertent or undesired removal of said charms 700 from one or more ends of the strand member 102 while the strand member ends 108, 112 are uncoupled to one another. To effectuate the same, the charm retention member 106 includes a retention surface 702 spanning upwardly at least partially in a transverse direction (represented with arrow 704) away from an outer surface 706 of the charm keeper body to a terminal end 708. In one embodiment, the retention surface 702 includes a substantially planar side surface that extends upwardly until it reaches the terminal end. The substantially planar side surface acts as a barrier or wall or prevent the charm 700 from passing thereby. In another embodiment, as shown in FIG. 7, the retention surface 702 includes a substantially planar side surface that extends upwardly to a curvilinear upper surface that includes the terminal end 708. In further embodiments, the side surface of the retention surface 702 is curvilinear.

Separating the terminal end 708 and point on the outer surface 706 where the charm retention member 106 protrudes, is a keeper off-set length 800. When the charm retention member 106 is in a fully extended position along a retention member translation path (represented as a linear path depicted in FIG. 8 with arrow 802), the keeper off-set length 800 and diameter/length 804, also generally referred to herein as "thickness," of the keeper body 102, combined, is greater than a maximum length of a diameter of the charm member 700. For example, when the charm retention member 106 is in the fully extended position (e.g., depicted in FIG. 8), it may have a length of approximately 0.25 inches. In combination with the keeper body thickness 804, e.g., 0.5 inches, the total combined thickness may be 0.75. The one or more charm members 700 defining a lumen with a lumen diameter may have a maximum length of said diameter being approximately 0.6 inches, whereby the combined length, or thickness of the keeper body 102 and keeper off-set length 800, is greater than said maximum lumen diameter, thereby preventing the charm member 700 from being inadvertently removed or even passing to the clasp member disposed adjacent thereto. As those of skill in the an will appreciate, the lumen diameter is greater than the diameter of the strand member 102 to permit the charm member 700 to be inserted and or slid thereon.

When the one or more charm members 700 are desired by the user 10 be removed from the strand member 102, a user will apply a force to the charm retention member 106 to translate it to a compressed position (e.g., depicted in FIG. 9) along the retention member translation path 802. When in the compressed position, the keeper off-set length 800 and the keeper body width 804, combined, are less than the lumen diameter, including the maximum lumen diameter, thereby permitting the charm member 700 to enter and egress from the strand member 102 and clasp disposed adjacent thereto, e.g., the first clasp member 108.

More specifically, the keeper body 104 may define an aperture 202 (shown in FIG. 2) that is sized and shaped to permit a portion of the charm retention member 106 to protrude therefrom, as depicted in the figures. In one embodiment, the aperture 202 may be a single aperture defined on the keeper body 104. Additionally, the keeper body 104 may enclose a spring assembly 806 that supplies a biasing force in a transverse direction, e.g., direction 704. Said another way, the spring assembly 806 may also be at least partially housed within the keeper body 104 and is operably configured to permit the charm retention member 106 to translate through said aperture 202. Said differently, the charm retention member 106 may be "spring-loaded" and the spring assembly 806 biases the spring-loaded charm retention member 106 in the fully extended position (e.g., depicted in FIG. 8). In one example, the force needed to overcome the spring constant of the spring employed in the spring assembly 806 may be 1-2 lb.

The spring assembly 806 may include one end 808 of the spring directly coupled to a lower inner surface of the keeper body 104 and another end 810 directly coupled to a lower surface 812 of the charm retention member 106. Additionally, the spring assembly 806 may be housed within opposing walls to resist against lateral or longitudinal movement. The keeper body 104 may also include internal structures, walls, and/or surfaces to prevent the charm retention member 106 from fully exiting the keeper body 104 and/or aperture 202. The charm retention member 106 and keeper body 104 may be of a substantially rigid material, e.g., PVC (Shore D 30-80) and/or stainless steel. The charm retention member 106 may be retained within the keeper body 104 by snapping two halves of the keeper body 104 together. In another embodiment, the charm retention member 106 may be retained within the keeper body 104 my inserting it and the spring assembly 806 into an end, e.g., end 814, of the keeper body 104 and then soldering or welding the strand member end within the keeper body 104.

Referring now to FIG. 3 in connection with FIGS. 7-9, the spring-loaded charm retention member 106 may include an upper surface 110 disposed outside of the keeper body 104 when the charm retention member 106 is in the fully extended position. The upper surface 106 of the charm retention member 106 may be of a curvilinear shape to facilitate in supplying a downward force by a charm member 700 that is inserted, via the lumen, through the male configuration 300. The curvilinear shape also enables the user to apply the compression force on the spring in a more comfortable manner by sliding his or her finger on the upper surface 106 of the charm retention member 106.

Additionally, the charm retention member 106 may also include a height separating the upper surface 106 of the charm retention member 106 and the outer surface 706 of the charm keeper body 104, when the charm retention member is in the fully extended position. The height, or height profile, of the upper surface 106 with respect to the outer surface 706, may taper in the longitudinal direction toward the clasp member, e.g., first clasp member 108, disposed adjacent to the keeper body 104. This again effectuates in the supplying of a downward force by a charm member 700 that is inserted, via the lumen, through the male configuration 300. In one embodiment, a visual end 302 of the charm retention member 106 is at least substantially flush or level with the outer surface 706 of the keeper body 104. This configuration facilitates in transferring the charm member 700 over the charm retention member 106 and, when continually sliding the charm member 700 longitudinally across the charm retention member 106, compressing the charm retention member 106 to permit the charm member 700 to enter the strand member 102. When an end, e.g., end 710, of the charm member 700 passes a proximal end, e.g., end 712, of the charm retention member 106, the charm retention member 106, which may be biased by the spring assembly 806, is placed in the fully extended position. In other embodiments, the user may physically translate, and lock, the charm retention member 106 in the fully extended position and compressed position using, for example, a vertically disposed tongue-and-groove and/or notch and recess configuration.

As those of skill in the art will appreciate, the charm keeper body 104 may define an aperture 202 sized and shaped to permit the charm retention member 106 to translate therethrough. The keeper body 104, lumen, charm member 700, strand member 102, first clasp member/male configuration 108, 300 may be of a cylindrical shape to facilitate in further quick and efficient removal or placement of one or more charm members 700. Other shapes, however, e.g., rectangular or triangular, may be utilized. Moreover, as those of skill in the art will also appreciate, the keeper body 104 may include a maximum keeper body thickness 804, along with a maximum thickness of the male configuration, e.g., thickness 714, that is less than a minimum length of the lumen diameter to facilitate in permitting efficient and effective entry and egress of the charm member 700.

A charm keeper assembly has been disclosed that effectuates quick and easy removal of a charm on a strand member, such as a bracelet, necklace, or other strand member. Beneficially, the charm keeper assembly also employs the use of a charm retention member, generally independent of any clasps on said strand member, to retain said one or more pieces of jewelry on the strand member when the opposing ends of the strand member are uncoupled from one another.

What is claimed is:

1. A charm keeper assembly comprising:

an elongated and flexible strand member having a first free end and a second free end opposing the first free end, the strand member defining a strand member diameter;

a first clasp member of a male configuration and disposed at the first free end of the elongated strand member and a second clasp member of a female configuration sized and shaped to receive a portion of the male configuration and disposed at the second free end of the elongated strand member, the first and second clasp members operably configured to engage and lock with one another to couple the first and second free ends together and form a circular shape;

a charm keeper body disposed adjacent to the first clasp member and with a keeper body thickness and independently disposed adjacent to at least one of the first and second clasp members and having a spring-loaded charm retention member at least partially housed within the keeper body and including a retention surface spanning upwardly in a transverse direction away from an outer surface of the charm keeper body to a terminal end defining a keeper off-set length when the spring-loaded charm retention member is in a fully extended position along a retention member translation path and with the charm keeper body defining an aperture sized and shaped to permit the spring-loaded charm retention member to translate therethrough; and at least one charm member defining a lumen with a lumen diameter having a maximum length less than the off-set length and the keeper body thickness, combined, when the charm retention member is in the fully extended position, and greater than the strand member diameter, wherein the keeper body is of a cylindrical shape and has a maximum keeper body thickness, along with a maximum thickness of the male configuration, is less than a minimum length of the lumen diameter.

2. The charm keeper assembly according to claim 1, wherein the retention member translation path further comprises:

a compressed position with the keeper off-set length and the keeper body width, combined, less than the lumen diameter.

3. The charm keeper assembly according to claim 2, wherein the spring-loaded charm retention member further comprises:

an upper surface disposed outside of the keeper body, when the charm retention member is in the fully extended position, wherein the upper surface of the spring-loaded charm retention member is of a curvilinear shape.

4. The charm keeper assembly according to claim 3, wherein the spring-loaded charm retention member further comprises:

a height separating the upper surface of the spring-loaded charm retention member and the outer surface of the charm keeper body, wherein, when the charm retention member is in the fully extended position, the height tapers in a longitudinal direction toward the at least one of the first and second clasp members adjacent to the charm keeper body.

5. The charm keeper assembly according to claim 4, wherein:

the first clasp member is of a male configuration and the second clasp member is of a female configuration sized and shaped to receive a portion of the male configuration, the first clasp member disposed adjacent to the charm keeper body.

6. The charm keeper assembly according to claim 1, wherein the keeper body further comprises:

a spring assembly housed therein and operably configured to permit the spring-loaded charm retention member to translate through an aperture defined by the keeper body, the spring assembly biasing the spring-loaded charm retention member in the fully extended position.

7. A charm keeper assembly comprising:

an elongated and flexible strand member having a first free end and a second free end opposing the first free end;

a first clasp member of a male configuration disposed at the first free end of the elongated strand member and a second clasp member of a female configuration disposed at the second free end of the elongated strand member, the male and female configurations operably configured to engage and lock with one another to couple the first and second free ends together and form a circular shape;

a charm keeper body with a keeper body thickness and disposed adjacent to the first clasp member and having an outer surface enclosing a spring assembly, the outer surface defining an aperture thereon;

a charm retention member at least partially housed and retained within the keeper body, protruding from the aperture defined by the charm keeper body, and including a retention surface spanning upwardly in a transverse direction away from the outer surface of the charm keeper body to a terminal end defining a keeper off-set length when the charm retention member is in a fully extended position along a retention member translation path, the spring assembly biasing the spring-loaded charm retention member in the fully extended position; and at least one charm member defining a lumen with a lumen diameter having a maximum length less than the off-set length when the charm retention member is in the fully extended position and the keeper body thickness, combined.

8. The charm keeper assembly according to claim 7, wherein:

the outer surface defines a single aperture thereon.

9. The charm keeper assembly according to claim 7, wherein the strand member further comprises:

a strand member diameter defined by the strand member, wherein the maximum length of the lumen diameter is greater than the strand member diameter.

10. The charm keeper assembly according to claim 7, wherein the retention member translation path further comprises:

a compressed position with the keeper off-set length and the keeper body thickness, combined, less than the lumen diameter.

11. The charm keeper assembly according to claim 10, wherein the charm retention member further comprises:

an upper surface disposed outside of the keeper body, when the charm retention member is in the fully extended position, wherein the upper surface of the spring-loaded charm retention member is of a curvilinear shape.

12. The charm keeper assembly according to claim 11, wherein the charm retention member further comprises:

a height separating the upper surface of the charm retention member and the outer surface of the charm keeper body, wherein, when the charm retention member is in the fully extended position, the height tapers in a longitudinal direction toward the first clasp member.

13. The charm keeper assembly according to claim 12, wherein:

the first clasp member is of a male configuration and the second clasp member is of a female configuration sized and shaped to receive a portion of the male configuration, the first clasp member disposed adjacent to the charm keeper body.

14. The charm keeper assembly according to claim 7, wherein:

the keeper body is of a cylindrical shape and has a maximum thickness that, along with a maximum width of the male configuration, is less than a minimum length of the lumen diameter.

15. The charm keeper assembly according to claim 7, wherein:

the charm keeper body is independently disposed adjacent to the first clasp member.

16. A charm keeper assembly comprising:

an elongated and flexible strand member having a first free end and a second free end opposing the first free end, the strand member defining a strand member diameter;

a first clasp member disposed at the first free end of the elongated strand member and a second clasp member disposed at the second free end of the elongated strand member, the first and second clasp members operably configured to engage and lock with one another to couple the first and second free ends together and form a circular shape;

a charm keeper body with a keeper body thickness and independently disposed adjacent to at least one of the first and second clasp members and having a spring-loaded charm retention member at least partially housed within the keeper body and including a retention surface spanning upwardly in a transverse direction away from an outer surface of the charm keeper body to a terminal end defining a keeper off-set length when the spring-loaded charm retention member is in a fully extended position along a retention member translation path, the keeper body having a spring assembly housed therein and operably configured to permit the spring-loaded charm retention member to translate through an aperture defined by the keeper body, the spring assembly biasing the spring-loaded charm retention member in the fully extended position; and at least one charm member defining a lumen with a lumen diameter having a maximum length less than the off-set length and the keeper body thickness, combined, when the charm retention member is in the fully extended position, and greater than the strand member diameter.

* * * * *